US007390778B1

(12) United States Patent
Strang et al.

(10) Patent No.: US 7,390,778 B1
(45) Date of Patent: Jun. 24, 2008

(54) CLEANING COMPOSITIONS THAT REDUCE SHRINKAGE OF FABRICS

(75) Inventors: Janine Morgens Strang, Deer Park, OH (US); Michael Peter Siklosi, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/763,049

(22) PCT Filed: Aug. 24, 1999

(86) PCT No.: PCT/US99/19204

§ 371 (c)(1),
(2), (4) Date: Feb. 16, 2001

(87) PCT Pub. No.: WO00/11133

PCT Pub. Date: Mar. 2, 2000

(51) Int. Cl.
*C11D 3/44* (2006.01)
*C11D 1/66* (2006.01)

(52) U.S. Cl. ..... 510/520; 510/276; 510/295; 510/281; 510/285; 510/289; 510/304; 510/342; 510/432; 510/525

(58) Field of Classification Search ..... 8/137; 510/285, 287, 289, 304, 295, 342, 338, 407, 510/519, 276, 281, 432, 520, 525
See application file for complete search history.

(56) References Cited

U.S. PATENT DOCUMENTS

| | | | | | |
|---|---|---|---|---|---|
| 4,472,166 | A | | 9/1984 | Sando et al. | |
| 4,965,100 | A | * | 10/1990 | Leigh et al. | 427/242 |
| 5,021,263 | A | | 6/1991 | Kastele et al. | |
| 5,021,264 | A | | 6/1991 | Kastele et al. | |
| 5,066,413 | A | * | 11/1991 | Kellett | 252/8.75 |
| 5,238,587 | A | * | 8/1993 | Smith et al. | 510/277 |
| 5,547,476 | A | * | 8/1996 | Siklosi et al. | 8/142 |
| 5,591,236 | A | * | 1/1997 | Roetker | 8/137 |
| 5,630,847 | A | * | 5/1997 | Roetker | 8/137 |
| 5,658,651 | A | * | 8/1997 | Smith et al. | 442/59 |
| 5,746,776 | A | * | 5/1998 | Smith et al. | 8/142 |
| 5,789,368 | A | | 8/1998 | You et al. | |
| 5,865,851 | A | * | 2/1999 | Sidoti et al. | 8/142 |
| 5,869,410 | A | * | 2/1999 | Smith et al. | 442/333 |
| 5,908,473 | A | | 6/1999 | Weller et al. | |
| 5,972,041 | A | * | 10/1999 | Smith et al. | 8/142 |
| 5,997,586 | A | | 12/1999 | Smith et al. | |
| 6,086,634 | A | * | 7/2000 | Smith | 8/142 |
| 6,086,635 | A | | 7/2000 | Berndt et al. | |
| 6,132,474 | A | | 10/2000 | Smith et al. | |
| 6,179,880 | B1 | | 1/2001 | Smith | |
| 6,238,736 | B1 | * | 5/2001 | Smith et al. | 427/242 |
| 6,254,932 | B1 | * | 7/2001 | Smith et al. | 427/242 |

FOREIGN PATENT DOCUMENTS

| | | |
|---|---|---|
| EP | 0 867 556 A1 | 9/1989 |
| SU | 1516-553 A | 10/1989 |
| WO | WO 96/30471 | 10/1996 |
| WO | WO 97/32004 | 9/1997 |

* cited by examiner

*Primary Examiner*—Charles I Boyer
(74) *Attorney, Agent, or Firm*—Mark A. Charles; Kim William Zerby; Steven W. Miller

(57) ABSTRACT

A composition for treating fabrics, comprising: a) a fabric shrinkage reducing composition selected from the group consisting of ethylene glycol, all isomers of propanediol, butanediol, pentanediol, hexanediol and mixtures thereof; b) a liquid cleaning/refreshment composition. The fabric shrinkage reducing composition and the liquid cleaning/refreshment composition are releasably absorbed in a substrate in a weight ratio of from about 1:2 to about 1:5. The fabric shrinkage reducing composition helps to reduce shrinkage of the fabrics treated in an in-home, non-immersion cleaning and refreshing process which is conducted in a clothes dryer, or the like apparatus. Also provided are non-immersion cleaning/refreshment processes using this composition, a kit containing the necessary items to conduct the processes of this invention and a sheet for releasably absorbing the compositions of this invention.

10 Claims, 1 Drawing Sheet

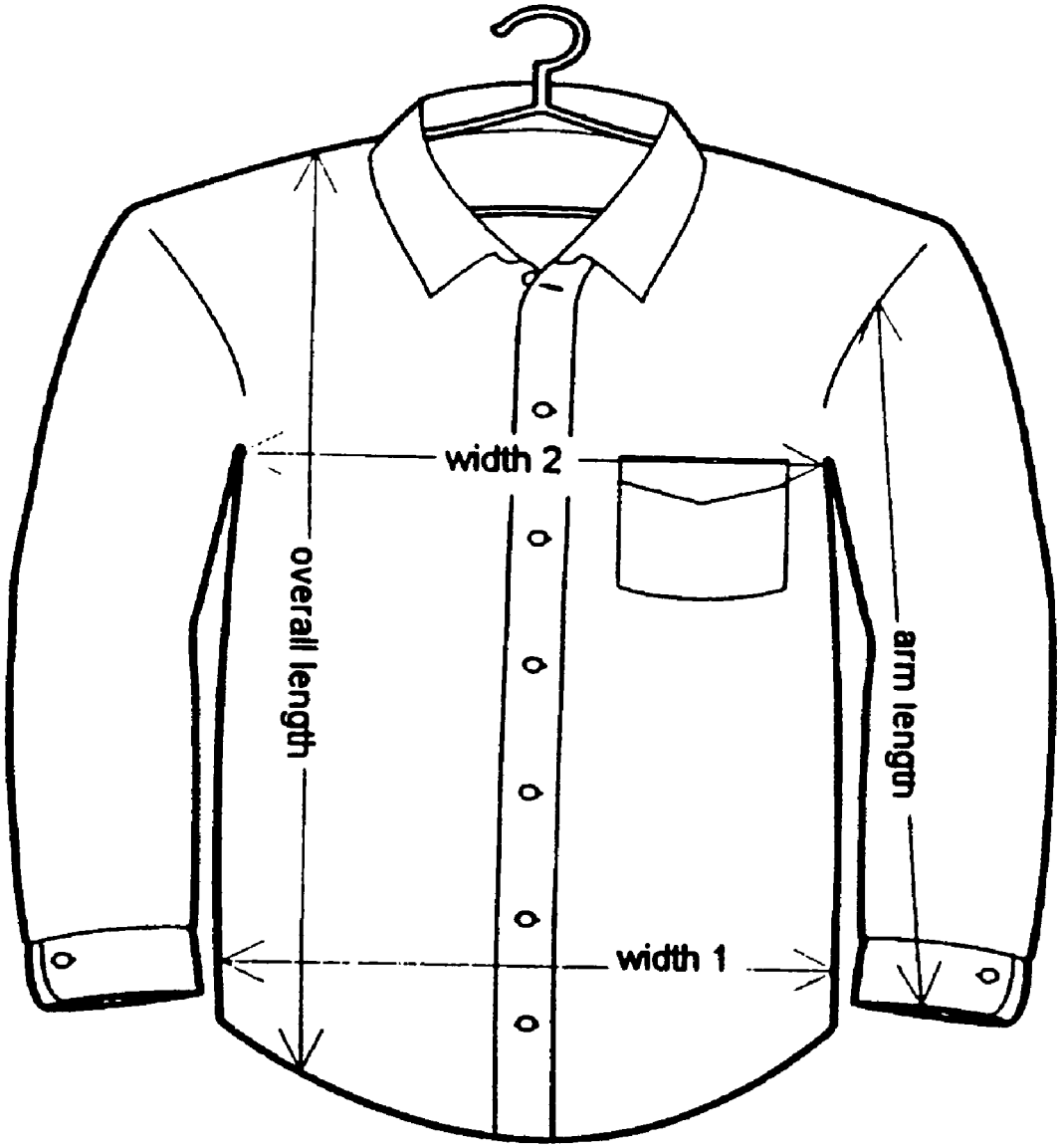
width 2
overall length
arm length
width 1

CLEANING COMPOSITIONS THAT REDUCE SHRINKAGE OF FABRICS

TECHNICAL FIELD

The present invention relates to compositions and articles containing these compositions that are designed to clean and refresh fabrics in a non-immersion cleaning process while minimizing shrinkage of the fabrics.

BACKGROUND OF THE INVENTION

Certain delicate fabrics are not suitable for conventional in-home immersion cleaning processes. Home washing machines, which provide excellent cleaning results for the majority of fabrics used in today's society, can, under certain conditions, shrink or otherwise damage silk, linen, wool and other delicate fabrics. Consumers typically have their delicate fabric items "dry-cleaned". Unfortunately, dry-cleaning usually involves immersing the fabrics in various hydrocarbon and halocarbon solvents that require special handling and must be reclaimed, making the process unsuitable for in-home use. Hence, dry-cleaning has traditionally been restricted to commercial establishments making it less convenient and more costly than in-home laundering processes. But, excluding cost and convenience, dry-cleaning processes remain generally superior to in-home, immersion laundering processes for minimizing fabric shrinkage.

Attempts have been made to provide in-home dry-cleaning systems that combine the fabric cleaning and refreshing of in-home, immersion laundering processes with the fabric care benefits of dry-cleaning processes. One such in-home system for cleaning and refreshing garments comprises a substrate sheet containing various liquid or gelled cleaning agents, and a plastic bag. The garments are placed in the sheet, and then tumbled in a conventional clothes dryer. In a current commercial embodiment, multiple single-use flat sheets comprising a cleaning/refreshing agent and a single multi-use plastic bag are provided in a package. Unfortunately, such in-home processes are sub-optimal with respect to fabric shrinkage. To be clear, these in-home, non-immersion processes are substantially superior to in-home, immersion processes with respect to minimizing fabric shrinkage. And these in-home, non-immersion processes are similar to commercial dry-cleaning processes with respect to minimizing fabric shrinkage, but some minor amount of shrinkage can occur as a result of either process. Thus, there is a continuing need to find improved in-home, non-immersion cleaning and refreshing processes, and cleaning and refreshing compositions for use therein, which provide acceptable cleaning while minimizing fabric shrinkage.

It has now also been unexpectedly discovered that certain organic compounds when used with a cleaning/refreshment composition within defined ratios, can reduce the amount of shrinkage that occurs during an in-home, non-immersion cleaning/refreshment process. The present invention provides such a composition, and when used in the processes of this invention, and with the kits of this invention, fabrics can be cleaned and refreshed with substantially less shrinkage than conventional in-home immersion laundering processes. When using the composition, processes and kits of this invention the fabric shrinkage levels are comparable to, and in some cases substantially better than, commercial dry-cleaning with a solvent immersion process.

SUMMARY OF THE INVENTION

In one aspect of the present invention there is provided a composition for treating fabrics that comprises:

a) a fabric shrinkage reducing composition selected from the group consisting of ethylene glycol, all isomers of propanediol, butanediol, pentanediol, hexanediol and mixtures thereof, and more preferably selected from the group consisting of neopentyl glycol, polyethylene glycol, 1,2-propanediol, 1,3-butanediol, 1-octanol and mixtures thereof; and b) a liquid cleaning/refreshment composition.

The fabric shrinkage reducing composition and the liquid cleaning/refreshment composition are preferably releasably absorbed in a substrate in a weight ratio of from about 1:2 to about 1:5, preferably from about 1:2 to about 1:4, more preferably from about 1:3 to about 1:4, and most preferably about 1:3.6. The cleaning/refreshment composition preferably comprises water and a member selected from the group consisting of surfactants, perfumes, preservatives, bleaches, auxiliary cleaning agents, organic solvents and mixtures thereof. The preferred organic solvents are glycol ethers, specifically, methoxy propoxy propanol, ethoxy propoxy propanol, propoxy propoxy propanol, butoxy propoxy propanol, butoxy propanol and mixtures thereof. The surfactant is preferably a nonionic surfactant, such as an ethoxylated alcohol or ethoxylated alkyl phenol and is present at up to about 2%, by weight of the cleaning/refreshment composition.

In another aspect of the present invention there is provided an overall non-immersion cleaning/refreshment process for treating a fabric comprising the overall steps of:

(a) placing the fabric together with a substrate in a containment bag;

(b) placing the bag in a hot air clothes dryer, or the like apparatus, and operating the apparatus with heat and tumbling; and (c) removing the fabric from the bag.

In the process described above, releasably absorbed in the substrate is preferably:

(i) a fabric shrinkage reducing composition selected from the group consisting of ethylene glycol, all isomers of propanediol, butanediol, pentanediol, hexanediol and mixtures thereof, and more preferably selected from the group consisting of neopentyl glycol, polyethylene glycol, 1,2-propanediol, 1,3-butanediol, 1-octanol and mixtures thereof; and (ii) a liquid cleaning/refreshment composition.

Further, the fabric shrinkage reducing composition and the liquid cleaning/refreshment composition are preferably present in a weight ratio of from about 1:2 to about 1:5, preferably from about 1:2 to about 1:4, more preferably from about 1:3 to about 1:4, and most preferably about 1:3.6. Preferably, vapors are vented from the bag during step (b). Even more preferably, in the above process the fabric has a first side and a second side and the process further comprises the steps of:

(a) applying a spot cleaning composition from a dispenser to a discrete stained area of the first side of the fabric;

(b) concurrently or consecutively with Step (a), contacting the first side of the fabric adjacent the stained area with a treatment member; and (c) contacting the second side of the fabric adjacent the stained area with an absorbent stain receiving article.

In yet another aspect of this invention there is provided a kit, comprising:

(a) multiple substrates with the fabric shrinkage reducing composition and the liquid cleaning/refreshment composition defined above releasably absorbed therein;
(b) a re-usable containment bag;
(c) optionally, a treatment member;
(d) optionally, a separate portion of a spot cleaning composition;
(e) optionally, one or more absorbent stain receiver articles.

In the kits of this invention, the separate portion of the spot cleaning composition is preferably provided in a container, and the treatment member is the distal tip of the container.

In another aspect of this invention there is provided a sheet which is specifically adapted to clean and/or refresh fabrics in a hot air clothes dryer, comprising:

(a) a substrate;
(b) from about 10 grams to about 30 grams of a liquid cleaning/refreshment composition comprising at least about 80%, preferably at least about 90% and most preferably at least about 95%, by weight, of water releasably absorbed in the substrate;
(c) from about 2 grams to about 20 grams of a fabric shrinkage reducing composition selected from the group consisting of ethylene glycol, all isomers of propanediol, butanediol, pentanediol, hexanediol and mixtures thereof, and more preferably selected from the group consisting of neopentyl glycol, polyethylene glycol, 1,2-propanediol, 1,3-butanediol, 1-octanol and mixtures thereof releasably absorbed in the substrate.

The sheet of this invention preferably further comprises a vapor permeable fibrous coversheet that encases the outer surfaces of the substrate, and that is permeable to the cleaning/refreshment composition and the fabric shrinkage reducing composition. The coversheet preferably has a minimum thickness of at least about 8 mils, and is bonded to the substrate in discrete areas.

BRIEF DESCRIPTION OF THE DRAWINGS

While this specification concludes with claims that distinctly define the present invention, it is believed that these claims can be better understood by reference to the Detailed Description Of The Invention and the drawings, wherein:

FIG. 1 is a schematic representation of a fabric garment showing the measurements used to calculate the amount of shrinkage after each cycle of a fabric treatment process.

DETAILED DESCRIPTION OF THE INVENTION

In one aspect, the present invention comprises a composition that is a mixture of a fabric shrinkage reducing composition and a liquid cleaning/refreshment composition. The fabric shrinkage reducing composition and the liquid cleaning/refreshment composition are releasably absorbed in a substrate, which is preferably in the form of a sheet, and even more preferably, the substrate is encased in coversheet. A non-immersion cleaning/refreshment process for treating a fabric is also defined herein. This process comprises the steps of:

(a) placing the fabric together with a substrate in a containment bag;
(b) placing the bag in a hot air clothes dryer, or the like apparatus, and operating the apparatus with heat and tumbling; and
(c) removing the fabric from the bag.

The fabric can be spot treated at anytime in conjunction with the cleaning and refreshing process of this invention, preferably the spot treatment occurs before the cleaning and refreshing step. The spot treatment process typically comprises the steps of:

(a) applying a spot cleaning composition from a dispenser to a discrete stained area on the first side of the fabric;
(b) concurrently or consecutively with Step (a), contacting the first side of the fabric adjacent the stained area with a treatment member; and
(c) contacting the second side of the fabric with an absorbent stain receiving article.

Each of the elements of this invention are described in turn below.

By "cleaning" herein is meant the removal of soils and stains from fabrics. "Spot cleaning" is the localized cleaning on stained areas before or after the cleaning/refreshment step which is conducted in the bag. By "refreshment" herein is meant the removal of malodors and/or wrinkles from the overall fabrics, or the improvement of their overall appearance, other than primarily removing soils and stains, although some soil and stain removal can occur concurrently with refreshment.

"Shrinkage" is defined herein as the reduction in one or more of four different measurements on a test garment as shown in FIG. 1. Specifically, wool, wool/acrylic blends, cotton, ramie/cotton blends, and rayon/acrylic blend garments, such as sweaters were selected as test garments to determine the shrinkage resulting from various cleaning processes using various cleaning compositions. The test garments are referred to herein collectively as "long sleeve garments". While different garments can be used to test shrinkage, long sleeve garments have numerous dimensions that can shrink independently of each other. Thus, long sleeve garments were selected as test garments for experimental reasons only because they provide numerous data points. It is understood that fabric shrinkage generally occurs irrespective of the specific garment form.

As shown in FIG. 1, four specific dimensions are measured before and after each treatment cycle. All of the measurements are taken on the front of the long sleeve garment, after it has been placed on a hard, flat surface and smoothed by hand. That is, the long sleeve garments are not ironed before the measurements are taken. Permanent marker, colored stitching, or other methods can be used to mark the exact location of each measurement, so that after each treatment cycle the measurements are taken at the same location. With these guidelines, it can be seen from FIG. 1 that the "overall length" is the distance from the bottom hem of the long sleeve garment to the shoulder hem, the "arm length" is the distance between the hem on the bottom of one sleeve to the approximate mid-point of the hem joining the sleeve to the shirt, "width 1" is the distance between the side hems near the bottom of the shirt, and "width 2" is the distance between the two side hems near the arm pits of the shirt.

Shrinkage Reducing Composition

The shrinkage reducing composition of this invention is preferably selected from the group consisting of ethylene glycol, all isomers of propanediol, butanediol, pentanediol, hexanediol and mixtures thereof, and more preferably selected from the group consisting of neopentyl glycol, polyethylene glycol, 1,2-propanediol, 1,3-butanediol, 1-octanol and mixtures thereof. The shrinkage reducing composition is preferably neopentyl glycol or 1,2-propanediol, and is more preferably 1,2-propanediol. The ratio of shrinkage reducing composition to cleaning/refreshment composition is preferably from about 1:2 to about 1:5, preferably from about 1:2 to about 1:4, more preferably from about 1:3 to about 1:4, and most preferably about 1:3.6.

It has been shown that the mixture of a shrinkage reducing composition with a water based cleaning/refreshment composition as defined below, when used in the non-immersion fabric treatment processes defined herein, substantially reduces shrinkage of the treated garments when compared to substantially identical garments treated in an identical process using only the cleaning/refreshment composition. Moreover, it has been shown that using the shrinkage reducing compositions on one substrate and the cleaning/refreshment composition on a second substrate in the non-immersion processes of this invention, does not provide the substantial shrinkage reduction observed when the two compositions are releasably absorbed onto the same substrate.

While not wanting to be bound by any one theory, it is believed that the shrinkage reducing compositions of this invention help maintain the fibers of the treated fabrics in a relaxed state while the water based cleaning/refreshment composition treats the fabrics. The relaxed fibers are less prone to shrinkage. As mentioned above, the reduced shrinkage is measured against a non-immersion process using only a cleaning/refreshment composition. It bears noting that a non-immersion process using only a cleaning/refreshment composition causes substantially less shrinkage than a conventional immersion laundering process. Thus, the compositions and processes taught herein are not only an improvement over known non-immersion processes, they are also a substantial improvement over conventional immersion laundering processes.

Cleaning/Refreshment Composition

The cleaning/refreshment composition preferably comprises water and a member selected from the group consisting of surfactants, perfumes, preservatives, bleaches, auxiliary cleaning agents, organic solvents and mixtures thereof. The preferred organic solvents are glycol ethers, specifically, methoxy propoxy propanol, ethoxy propoxy propanol, propoxy propoxy propanol, butoxy propoxy propanol, butoxy propanol and mixtures thereof. The surfactant is preferably a nonionic surfactant, such as an ethoxylated alcohol or ethoxylated alkyl phenol, and is present at up to about 2%, by weight of the cleaning/refreshment composition. Typical fabric cleaning refreshment/compositions herein can comprise at least about 80%, by weight, water, preferably at least about 90%, and more preferably at least about 95% water.

The Examples below give specific ranges for the individual components of preferred cleaning/refreshment compositions for use herein. A more detailed description of the individual components of the cleaning/refreshment compositions, that is, the organic solvents, surfactants, perfumes, preservatives, bleaches and auxiliary cleaning agents can be found in U.S. Pat. No. 5,789,368, which issued on Aug. 4, 1998 to You et al. The entire disclosure of the You et al. patent is incorporated herein by reference. Additionally, cleaning/refreshment compositions are described in co-pending U.S. patent application Ser. No. 08/789,171, which was filed on Jan. 24, 1997, in the name of Trinh et al. The entire disclosure of the Trinh et al. Application is incorporated herein by reference.

Substrate

When used in the in-dryer step of the present process, the shrinkage reducing composition and the cleaning/refreshment composition are releasably absorbed used in combination with an absorbent substrate, herein after referred to as a "substrate". The substrate releasably contains the compositions. By "releasably contains" means that the compositions are effectively released from the substrate onto the soiled fabrics as part of the non-immersion cleaning and fabric refreshment processes herein. This release occurs mainly by volatilization of the composition from the substrate through the vapor-permeable coversheet, or by a combination of vapor and liquid transfer, although bulk liquid transfer is desirably minimized by means of the coversheet herein.

The substrate can be in any desired form, such as powders, flakes, shreds, and the like. However, it is highly preferred that the substrate be in the form of an integral pad or "sheet" that substantially maintains its structural integrity throughout the process. The substrates and sheets of this invention are sometimes referred to in the literature as "carriers" or "absorbent carrier sheets"; it is understood that all of these labels refer to liquid absorbing materials that can be used to conveniently transport liquids. Such substrates are described in detail in U.S. Pat. No. 5,789,368, to You et al. which was incorporated herein by reference above. The manufacture of these sheets forms no part of this invention and is already disclosed in the literature. See, for example, U.S. Pat. Nos. 5,009,747, Viazmensky, et al., Apr. 23, 1991 and 5,292,581, Viazmensky, et al., Mar. 8, 1994, which are incorporated herein by reference.

The substrate is intended to contain a sufficient amount of the shrinkage reducing composition and cleaning/refreshment compositions to be effective for their intended purpose. The capacity of the substrate for such compositions will vary according to the intended usage. The size of the substrate should not be so large as to be unhandy for the user. Typically, the dimensions of the substrate will be sufficient to provide a macroscopic surface area (both sides of the substrate) of at least about 360 $cm^2$, preferably in the range from about 360 $cm^2$ to about 3000 $cm^2$. For example, a generally rectangular substrate may have the dimensions (X-direction) of from about 10 cm to about 35 cm, and (Y-direction) of from about 18 cm to about 45 cm.

Coversheet

The coversheets employed herein are distinguished from the substrate, inasmuch as the coversheets are relatively non-absorbent to the shrinkage reducing compositions and cleaning/refreshment compositions as compared with the substrate. The coversheets are constructed from hydrophobic fibers which tend not to absorb, "wick" or otherwise promote the transfer of fluids. While fluids can pass through the void spaces between the fibers of the coversheet, this occurs mainly when excessive pressure is applied to the article. Thus, under typical usage conditions the coversheet provides a physical barrier which keeps the absorbent substrate, which is damp from its load of shrinkage reducing composition and cleaning/refreshment composition, from coming into direct contact with the fabrics being treated. Yet, the coversheet does allow vapor transfer of the shrinkage reducing composition and cleaning/refreshment composition from the substrate through the coversheet and into the containment bag, and thus onto the fabrics being treated. If desired, the coversheet can be provided with macroscopic fenestrations through which the lint, fibers or particulate soils can pass, thereby further helping to entrap such foreign matter inside the article, itself.

Such fibrous, preferably heat resistant and, most preferably, hydrophobic, coversheets are described in detail in U.S. Pat. No. 5,789,368, to You et al. which was incorporated herein by reference above. Additionally, co-pending U.S. provisional application 60/077,556, which was filed on Mar. 11, 1998, in the name of Wise et al., describes certain improvements to the coversheets of this invention. The entire disclosure of the Wise et al. application is incorporated herein by reference. Suitable combinations of the coversheets described in You et al. with the improvements described in Wise et al. can be employed, according to the desires of the manufacturer, without departing from the spirit and scope of the invention.

One potential problem with the sheets of this invention, that is the substrate or the combination of a substrate and a coversheet, is that they may be overused by the consumer. The sheets are typically provided with enough shrinkage reducing composition and cleaning/refreshment composition for one use. If after the first use the sheet looks clean, the consumer may be inclined to reuse it. Reusing a sheet that contains an insufficient amount of shrinkage reducing composition and cleaning/refreshment composition will generally be ineffective. Thus, an indicator, such as a dye that changes color, can be added to either of the substrate or the coversheet. The indicator will alert the consumer that the sheet has been used and should be discarded. Preferably, the indicator changes the sheet color to yellow, brown or gray.

In the Wise et al. reference incorporated herein above, a different, yet equally effective solution to this problem is proposed. Specifically, a tackiness agent is applied to the sheet. The tackiness agent attracts and collects loose fibers, hair, lint and other stray matter from the fabrics being treated. This not only serves to remove these undesirable items from the fabrics, it serves as an indicator as well. At the end of the treatment process the stray material that becomes affixed to the sheet gives the sheet a "dirty" appearance, signaling the consumer to throw the sheet away.

Containment Bag

The present invention provides a non-immersion cleaning and refreshing process that is carried out in a containment bag. The process herein can be conducted in a sealed bag, but in a highly preferred mode, the process of the present invention employs a vapor-venting containment bag. The bag is preferably designed for multiple uses and reuses, and is especially adapted for use by the consumer in most conventional hot air clothes dryer apparatus, such as those found in the home. The bag is designed to vent water and other vapors (including malodorous materials) which emanate from within the bag when used in the manner described herein. The vapors released from the bag are then exhausted through the air vent of the dryer apparatus.

The design of the venting ability of the bag achieves a proper balance of the above effects. A tightly-sealed, vapor impermeable "closed" bag will not purge malodors and will overly moisten the fabrics, resulting in wrinkling. An overly "open" bag design will not sufficiently moisten the fabrics or soils to mobilize heavier malodors or to remove pre-existing fabric wrinkles. Further, the bag must be "closed" enough to billow and create a void volume under water vapor pressure, wherein the fabrics can tumble freely within the bag and be exposed to the vapors.

The preferred venting bags, and methods of using the bags in a non-immersion cleaning and refreshing process, are described in U.S. Pat. No. 5,789,368, to You et al. which was incorporated herein by reference above. Additional disclosure of the bags, methods of using and making the bags, and materials of construction for the bags that are preferred for use in this invention can be found in U.S. Pat. No. 5,762,648, which issued on Jun. 9, 1998, to Yeazell, and in U.S. Pat. No. 5,681,355, which issued on Oct. 28, 1997, to Davis et al. Both the Yeazell patent and the Davis et al. patent are incorporated herein by reference.

More specifically, the preferred vapor-venting containment bags for use in this invention are designed to vent at least about 40%, preferably at least about 60%, up to about 90%, preferably no more than about 80%, by weight, of the total moisture introduced into the bag before the operating cycle of the clothes dryer, or other hot air apparatus, used in the processes herein. The percentage of vapor-venting can be determined from the Vapor-Venting Evaluation Test (VVE) that is defined below, in Example IV. As noted above, the preferred containment bags are designed to achieve a degree of venting, or VVE "score", of at least about 40% (40 VVE), preferably at least about 60% (60 VVE), up to about 90% (90 VVE), even more preferably no more than about 80% (80 VVE).

Spot Cleaning Composition

The user of the present process can be provided with various spot cleaning compositions to use in the optional pre-spotting procedure of this invention. These compositions are used to remove localized stains from the fabrics being treated, either before or after the cleaning and refreshing process defined herein. Necessarily, the spot cleaning composition must be compatible with the fabric being treated. That is, no meaningful amount of dye should be removed from the fabric during the spot treatment and the spot cleaning composition should leave no visible stains on the fabric. Therefore, in a preferred aspect of this invention there are provided spot cleaning compositions which are substantially free of materials that leave visible residues on the treated fabrics. This necessarily means that the preferred compositions are formulated to contain the highest level of volatile materials possible, preferably water, typically about 95%, preferably about 97.7%, and surfactant at levels of about 0.1% to about 0.7%. A preferred spot cleaning composition will also contain a cleaning solvent such as butoxy propoxy propanol (BPP) at a low, but effective, level, typically about 1% to about 4%, preferably about 2%.

Preferred spot cleaning compositions are exemplified below, and are described in U.S. Pat. No. 5,789,368, to You et al. which was incorporated herein by reference above. Additionally, spot cleaning compositions are described in U.S. Pat. No. 5,630,847, which issued on May 20, 1997, to Roetker. The entire disclosure of the Roetker patent is incorporated herein by reference.

Treatment Member

In one embodiment, a treatment member is provided to assist in removing localized stains from fabrics. In a preferred aspect of this invention, the spot cleaning composition is provided in a dispenser, such as a bottle, and the dispenser has a distal tip that can serve as the treatment member. Additionally, the treatment member can comprise an absorbent base material which can be, for example, a natural or synthetic sponge, an absorbent cellulosic sheet or pad, or the like. In contact with and extending outward from this base material can be multiple protrusions. Specific examples of treatment members can be found in U.S. Pat. No. 5,789,368, to You et al. which was incorporated herein by reference above.

Absorbent Stain Receiving Article

An absorbent stain receiving article, sometimes referred to herein as a stain receiver, can optionally be used in the optional pre-spotting operations herein. Such stain receivers can be any absorbent material which imbibes the liquid composition used in the pre-spotting operation. Disposable paper towels, cloth towels such as BOUNTY™ brand towels, clean rags, etc., can be used. However, in a preferred mode the stain receiver is designed specifically to "wick" or "draw" the liquid compositions away from the stained area. One preferred type of stain receiver consists of a nonwoven pad, such as a thermally bonded air laid fabric ("TBAL"). Another highly preferred type of stain receiver for use herein comprises polymeric foam, wherein the polymeric foam comprises a polymerized water-in-oil emulsion, sometimes referred to as "poly-HIPE". The manufacture of polymeric foam is very extensively described in the patent literature; see, for example: U.S. Pat. No. 5,260,345 to DesMarais, Stone, Thompson, Young, LaVon and Dyer, issued Nov. 9, 1993; U.S. Pat. No. 5,550,167 to DesMarais, issued Aug. 27, 1996, and U.S. Pat. No. 5,650,222 to DesMarais et al., issued Jul. 22, 1997, all incorporated herein by reference. Typical conditions for forming the polymeric foams of the present invention are described in co-pending U.S. patent application Ser. No. 09/042,418, filed Mar. 13, 1998 by T. A. DesMarais, et al., titled "Absorbent Materials for Distributing Aqueous Liquids", the disclosure of which is incorporated herein by reference. Additional disclosure of conditions for forming the polymeric foams for use in the present invention are described in co-pending U.S. Provisional Patent Application Ser. No. 60/077,955, filed Mar. 13, 1998 by T. A. DesMarais, et al., titled "Abrasion Resistant Polymeric Foam And Stain Receivers Made Therefrom", the disclosure of which is incorporated herein by reference.

The various stain receivers described herein, and described in the references incorporated herein by reference, preferably comprise a liquid impermeable backsheet. The backsheet can be made of, for example, a thin layer of polypropylene, polyethylene and the like. The backsheet provides protection for the surface that the stain receiver rests on from the spot cleaning composition. For example, spot cleaning processes are typically performed on a hard surface, such as a table top. The stain receiver is placed on the table and the fabric to be treated in placed on the stain receiver. Spot cleaning composition is applied to the stained area of the fabric and then drawn into the stain receiver. But in the absence of a back sheet, the spot cleaning composition can leak onto the table top, possibly causing damage thereto.

While the backsheet preferably covers only one side of the absorbent stain receiver, leaving the opposite side exposed to receive the spot cleaning solution, the back sheet may extend over the edges of the receiver to protect against leakage of the spot cleaning solution from the edges of the stain receiver. But extending the backsheet over the edges and onto the absorbing side of the receiver minimizes the surface area available for receiving the spot cleaning solution. One solution to this paradox is to have a portion of the back sheet extend beyond one or more of the edges of the stain receiver in the form of "wings". The wings provide additional protection by insuring that the spot cleaning composition is contained if it leaks from the edges of the stain receiver, while simultaneously maximizing the absorbent surface area of the stain receiver.

Cleaning And Refreshing Processes

The shrinkage reducing composition and the cleaning/refreshment composition are loaded on the substrate which is preferably encased in a coversheet, and the substrate is placed in a bag with the fabrics to be treated. The bag is closed and placed in a heated operating clothes dryer, or the like, to remove malodors from the fabrics. The warm, humid environment created inside the bag volatilizes malodor components in the manner of a "steam distillation" process, and moistens fabrics and the soils thereon. This moistening of fabrics can loosen pre-set wrinkles, without setting of new wrinkles during the drying stage toward the end of the dryer cycle. Proper selection of the amount of shrinkage reducing composition and the cleaning/refreshment composition, and specifically the amount of water used in the process and, importantly, proper venting of the bag in the present manner can minimize shrinkage of the fabrics. Moreover, if the bag is not vented, the volatilized malodorous materials removed from the fabrics can undesirably be re-deposited thereon.

In more detail, the cleaning and refreshing process herein can be conducted in the following manner. Modifications of the process can be practiced without departing from the spirit and scope of the present invention.

(i) optionally, conducting a pre-spotting process according to the description below, on localized stained areas of the fabric;

(ii) placing the entire fabric together with the substrate that releasably contains a shrinkage reducing composition and a cleaning/refreshment composition in a containment bag;

(iii) placing the bag in a device to provide agitation, e.g., such as in a hot air clothes dryer and operating the dryer with heat and tumbling to moisten the fabric; and (iv) removing the fabric from the bag.

(v) promptly hanging the fabrics to complete drying and/or to prevent re-wrinkling.

More specifically, the cleaning and refreshment process is conveniently conducted in a tumbling apparatus, preferably in the presence of heat. The substrate containing the releasably absorbed shrinkage reducing composition and cleaning/refreshment composition is placed along with the fabrics to be treated in a nylon or other heat-resistant, and preferably vapor-venting bag. The bag is closed and placed in the drum of an automatic hot air clothes dryer at temperatures of 40° C.-150° C. The drum is allowed to revolve, which imparts a tumbling action to the bag and agitation of its contents concurrently with the tumbling. The tumbling and heating are carried out for a period of at least about 10 minutes, typically from about 20 minutes to about 60 minutes. This step can be conducted for longer or shorter periods, depending on such factors as the degree and type of soiling of the fabrics, the nature of the soils, the nature of the fabrics, the fabric load, the amount of heat applied, and the like, according to the needs of the user.

In more detail, a pre-spotting process can be conducted in the following manner. Modifications of the process can be practiced without departing from the spirit and scope of the present invention.

1. Place a stained area of the fabric over and in contact with the poly-HIPE or TBAL stain receiver described herein or, less preferably, an ordinary folded paper towel (e.g., preferably white or non-printed—to avoid dye transfer from the towel—BOUNTY® brand) on any suitable surface such as a table top, in a tray, etc.
2. Apply enough spot cleaning composition from a dispenser bottle with a narrow spout which directs the composition onto the stain (without unnecessarily saturating the surrounding area of the fabric) to saturate the localized stained area—about 10 drops; more may be used for a larger stain.
3. Optionally, let the composition penetrate the stain for 3-5 minutes.
4. Optionally, apply additional composition—about 10 drops; more may be used for larger stains.
5. Use the treatment member, such as the distal tip on the dispenser bottle to work the stain completely out. Contact can be maintained for a period of 1-60 seconds for lighter stains and 1-5 minutes, or longer, for heavier or more persistent stains.
6. Optionally, blot the fabric, e.g., between paper towels, to remove excess composition. Or, the treated area can be blotted with a dampened sponge or other absorbent medium to flush the fibers and remove excess composition.

The following Examples further illustrate the invention, but are not intended to be limiting thereof.

EXAMPLE I

Cleaning and Refreshing Compositions

Fabric cleaning/refreshment compositions according to the present invention, for use in a containment bag, are prepared as follows:

| Ingredient | % (wt.) |
|---|---|
| Emulsifier (TWEEN 20)* | 0.5 |
| Perfume | 0.5 |
| KATHON ® | 0.0003 |
| Sodium Benzoate | 0.1 |
| Water | Balance |

*Polyoxyethylene (20) sorbitan monolaurate available from ICI Surfactants.

Additionally, preferred compositions for use in the in-dryer cleaning/refreshment step of the process herein are as follows.

| Ingredient | % (wt.) | Range (% wt.) |
|---|---|---|
| Water | 99.0 | 95.1-99.9 |
| Perfume | 0.5 | 0.05-1.5 |
| Surfactant* | 0.5 | 0.05-2.0 |
| Ethanol or Isopropanol | 0 | Optional to 4% |
| Solvent (e.g. BPP) | 0 | Optional to 4% |

pH range from about 6 to about 8.

Besides the other ingredients, the foregoing compositions can contain enzymes to further enhance cleaning performance, as described in the Trinh et al. patent incorporated herein above.

EXAMPLE II

Preparation of a Substrate Comprising a Shrinkage Reducing Composition and a Cleaning/Refreshment Composition A 10¼ in.×14¼ in. (26 cm×36 cm) substrate in the form of a sheet is prepared from HYDRASPUN® material, manufactured by the Dexter Corp. The substrate sheet is covered on both sides with a topsheet and a bottomsheet of 8 mil (0.2 mm) Reemay fabric coversheet material. The coversheet (i.e., both topsheet and bottomsheet) are bonded to the substrate sheet by a Vertrod® or other standard heat sealer device, such as conventional sonic sealing devices, thereby bonding the laminate structure together around the entire periphery of the sheet. The edges of the sheet around its periphery are intercalated between the topsheet and bottomsheet by the bond. As noted above, the width of the bond is kept to a minimum and is about 0.25 in. (6.4 mm).

The bonded laminate sheet thus prepared is folded and placed in a pouch. Any plastic pouch which does not leak would be suitable. For example, a foil laminated pouch of the type used in the food service industry can be employed. Such pouches are well-known in the industry and are made from materials which do not absorb food flavors. In like manner, the formulator herein may wish to avoid absorption of the perfume used in the cleaning/refreshment composition by the pouch. Various pouches are useful herein and are commercially available on a routine basis.

The folded substrate/coversheet sheet is placed in the pouch. The folds can be of any type, for example, an accordion-style fold or rolled and then the roll is folded in half. This size is not critical but is convenient for placement in a pouch.

5 grams of the shrinkage reducing composition and 18 grams of the cleaning/refreshment composition are poured onto the substrate sheet/coversheet in any order, more preferably the shrinkage reducing composition and the cleaning/refreshment composition are mixed before pouring onto the substrate. The compositions are allowed to absorb into the substrate. The pouch is sealed immediately after the liquid product is introduced into the pouch and stored until time-of-use.

EXAMPLE III

Spot Cleaning Compositions

A spot cleaning composition for use for use in the present invention, preferably with a dispenser as defined above, and with a TBAL or poly-HIPE foam stain receiver, is prepared as follows:

| INGREDIENT | % (Wt.) (Nonionic) | Range % (Wt.) |
|---|---|---|
| Hydrogen peroxide | 1.000 | 0-2 |
| Amino tris(methylene phosphonic acid)* | 0.040 | 0-0.06 |
| Butoxypropoxypropanol (BPP) | 2.000 | 1-6 |
| Neodol 23 6.5 | 0.250 | 0-1 |
| Kathon preservative | 0.0003 | Optional** |
| Water | 96.710 | Balance |

pH target = 7; range = 6-8
*Stabilizer for hydrogen peroxide
**Sufficient to provide a preservative function.

Another example of a preferred, high water content, low residue spot cleaning composition for use in the pre-spotting step herein is as follows.

| INGREDIENT | Anionic Composition (%) |
|---|---|
| Hydrogen peroxide | 1.000 |
| Amino tris(methylene phosphonic acid)* | 0.0400 |
| Butoxypropoxypropanol (BPP) | 2.000 |
| $NH_4$ Coconut $E_1S$ | 0.285 |
| Dodecyldimethylamine oxide | 0.031 |
| Magnesium chloride | 0.018 |
| Magnesium sulfate | 0.019 |
| Hydrotrope, perfume, other minors, | 0.101 |
| Kathon preservative | 0.0003 |
| Water (deionized or distilled) | 96.507 |
| Target pH | 6.0 |

*Stabilizer for hydrogen peroxide

Preferably, to minimize the potential for dye damage as disclosed hereinabove, $H_2O_2$-containing pre-spotting compositions comprise the anionic or nonionic surfactant in an amount (by weight of composition) which is less than the amount of $H_2O_2$. Preferably, the weight ratio of surfactant: $H_2O_2$ is in the range of about 1:10 to about 1:1.5, most preferably about 1:4 to about 1:3.

EXAMPLE IV

Vapor Venting Evaluation Test (VVE)

Materials Needed for the VVE Test:

Envelope or "Standard", i.e., Control Containment Bag to be evaluated for VVE.

Carrier Substrate (15"×11"; 38.1 cm×27.9 cm) HYDRASPUN® carrier substrate sheet from Dexter with (10444) or without (10244) Binder.

Wool Blouse: RN77390, Style 12288, Weight approx. 224 grams.

Silk Blouse: RN40787, Style 0161, Weight approx. 81 grams.

Rayon Swatch: 45"×17" (114.3 cm×43.2 cm), Weight approx. 60 grams.

Pouch: 5"×6.375" (12.7 cm×16.2 cm) to contain the Substrate and water.

De-ionized Water; Weight is variable to establish VVE.

Pretreatment of Fabrics:

1. The wool, silk, and rayon materials are placed in a Whirlpool dryer (Model LEC7646DQO) for 10 minutes at high heat setting, with the heating cycle ranging from about 140° F.-165° F. to remove moisture picked up at ambient condition.
2. The fabrics are then removed from the dryer and placed in sealed nylon or plastic bags (minimum 3 mil. thickness) to minimize moisture pick up from the atmosphere.

Test Procedure:

1. Water of various measured weights from 0 to about 40 grams is applied to the substrate a minimum of 30 minutes before running a vented bag test. The substrate is folded, placed in a pouch and sealed.
2. Each fabric is weighed separately and the dry weights are recorded. Weights are also recorded for the dry substrate, the dry pouch containing the substrate, and the dry containment bag being evaluated.
3. Each garment is placed in the bag being evaluated for vapor venting along with the water-containing substrate (removed from its pouch and unfolded).
4. The bag is closed without expressing the air and placed in the Whirlpool Dryer for 30 minutes at the high heat setting, with tumbling per the standard mode of operation of the dryer.
5. At the end of 30 minutes the bag is removed from the dryer and each fabric, the substrate, the bag and the pouch are weighed for water weight gain relative to the dry state. (A possible minor loss in weight for the containment bag due to dryer heat is ignored in the calculations.)
6. The weight gain of each garment is recorded as a percent of the total moisture applied to the substrate.
7. The remaining unmeasured moisture divided by the total moisture is recorded as percent vented from the dryer bag.
8. When a series of total applied moisture levels are evaluated, it is seen that above about 15-20 grams of water the % vented becomes essentially constant, and this is the Vapor-Venting Equilibrium value, or VVE, for the particular bag venting design.

What is claimed is:

1. A sheet which is specifically adapted to clean and/or refresh fabrics in a hot air apparatus, the sheet comprising:

(a) a liquid absorbing substrate comprising a surface area of at least about 360 $cm^2$ wherein the substrate is a hydroentangled fabric;

(b) from about 10 grams to about 30 grams of a liquid cleaning/refreshment composition comprising at least about 80% by weight of water releasably absorbed in the substrate;

(c) from about 2 grams to about 20 grams of a fabric shrinkage reducing composition comprising a fabric shrinkage reducing agent selected from the group consisting of all isomers of pentanediol, hexanediol, and mixtures thereof releasably absorbed in the substrate.

2. The sheet according to claim 1, further comprising a permeable, fibrous coversheet which encases the outer surfaces of the sheet as the core element.

3. The sheet according to claim 1, wherein the cleaning/refreshment composition further comprises up to about 2%, by weight, of a nonionic surfactant.

4. The sheet according to claim 2, wherein the fibrous coversheet is vapor permeable to the cleaning/refreshment composition and the fabric shrinkage reducing composition; wherein the coversheet has a minimum thickness of at least about 8 mils.

5. The sheet according to claim 4, wherein the coversheet is bonded to the substrate in discrete areas.

6. A sheet which is specifically adapted to clean and/or refresh fabrics in a hot air apparatus, the sheet comprising:

(a) a liquid absorbing substrate comprising a surface area of at least about 360 $cm^2$ wherein the substrate is encased by a permeable, fibrous coversheet;

(b) from about 10 grams to about 30 grams of a liquid cleaning/refreshment composition comprising at least about 80% by weight of water releasably absorbed in the substrate;

(c) from about 2 grams to about 20 grams of a fabric shrinkage reducing composition comprising a fabric shrinkage reducing agent selected from the group consisting of all isomers of pentanediol, hexanediol, and mixtures thereof releasably absorbed in the substrate.

7. The sheet according to claim 6, wherein the cleaning/refreshment composition further comprises up to about 2%, by weight, of a nonionic surfactant.

8. The sheet according to claim 6, wherein the fibrous coversheet is vapor permeable to the cleaning/refreshment composition and the fabric shrinkage reducing composition; wherein the coversheet has a minimum thickness of at least about 8 mils.

9. The sheet according to claim 6, wherein the coversheet is bonded to the substrate in discrete areas.

10. The sheet according to claim 1, wherein the liquid absorbing substrate is a hydroentangled fabric.

* * * * *

UNITED STATES PATENT AND TRADEMARK OFFICE

CERTIFICATE OF CORRECTION

PATENT NO. : 7,390,778 B1
APPLICATION NO. : 09/763049
DATED : June 24, 2008
INVENTOR(S) : Janine Morgens Strang et al.

It is certified that error appears in the above-identified patent and that said Letters Patent is hereby corrected as shown below:

Column 1

Line 37, after “the” insert -- bag together with the --.

Signed and Sealed this

Twelfth Day of May, 2009

JOHN DOLL
*Acting Director of the United States Patent and Trademark Office*